US011139112B2

(12) United States Patent
Ishima et al.

(10) Patent No.: US 11,139,112 B2
(45) Date of Patent: Oct. 5, 2021

(54) ELECTRONIC COMPONENT

(71) Applicant: TDK CORPORATION, Tokyo (JP)

(72) Inventors: Yuya Ishima, Tokyo (JP); Yasushi Matsuyama, Tokyo (JP); Yuto Shiga, Tokyo (JP); Shunji Aoki, Tokyo (JP); Shinichi Kondo, Tokyo (JP)

(73) Assignee: TDK CORPORATION, Tokyo (JP)

( * ) Notice: Subject to any disclaimer, the term of this patent is extended or adjusted under 35 U.S.C. 154(b) by 333 days.

(21) Appl. No.: 15/892,784

(22) Filed: Feb. 9, 2018

(65) Prior Publication Data

US 2018/0240591 A1 Aug. 23, 2018

(30) Foreign Application Priority Data

Feb. 22, 2017 (JP) ..... JP2017-031175

(51) Int. Cl.

| | |
|---|---|
| ***H01F 27/30*** | (2006.01) |
| ***H01F 41/04*** | (2006.01) |
| ***H01F 27/32*** | (2006.01) |
| ***H01F 27/28*** | (2006.01) |
| ***H01F 27/29*** | (2006.01) |
| ***H01F 17/00*** | (2006.01) |

(52) U.S. Cl.
CPC ..... *H01F 41/04* (2013.01); *H01F 17/0013* (2013.01); *H01F 27/28* (2013.01); *H01F 27/292* (2013.01); *H01F 27/323* (2013.01)

(58) Field of Classification Search
CPC .... H01F 41/04; H01F 27/292; H01F 17/0013; H01F 27/323
USPC ..... 336/199, 200, 232
See application file for complete search history.

(56) References Cited

U.S. PATENT DOCUMENTS

| | | | | |
|---|---|---|---|---|
| 2008/0257488 | A1 | 10/2008 | Yamano | |
| 2012/0227250 | A1 | 9/2012 | Yamano | |
| 2013/0015937 | A1 | 1/2013 | Seko | |
| 2014/0253277 | A1* | 9/2014 | Takezawa | H01F 17/0013 336/200 |
| 2014/0375412 | A1 | 12/2014 | Seko | |
| 2015/0170834 | A1 | 6/2015 | Yamano | |
| 2015/0371757 | A1 | 12/2015 | Takezawa | |
| 2017/0103848 | A1 | 4/2017 | Yoneda et al. | |
| 2017/0110236 | A1* | 4/2017 | Jang | H01F 41/10 |
| 2017/0287620 | A1* | 10/2017 | Miyoshi | H01F 41/041 |
| 2018/0012697 | A1* | 1/2018 | Jung | H01F 17/0013 |
| 2018/0012700 | A1* | 1/2018 | Lee | H01F 17/0013 |

FOREIGN PATENT DOCUMENTS

| | | | |
|---|---|---|---|
| JP | 2008-147540 | A | 6/2008 |
| JP | 4816971 | B2 | 11/2011 |
| JP | 2013-038392 | A | 2/2013 |

(Continued)

*Primary Examiner* — Shawki S Ismail
*Assistant Examiner* — Kazi S Hossain
(74) *Attorney, Agent, or Firm* — Oliff PLC

(57) ABSTRACT

An electronic component includes an element provided with a first recess, and a mounting conductor including a first conductor portion disposed in the first recess. The first conductor portion has a first face opposed to a bottom face of the first recess, a second face opposed to the first face, and a third face connecting the first face and the second face. The third face has a region overlapping with the second face as viewed from an opposing direction of the bottom face of the first recess and the first face.

9 Claims, 3 Drawing Sheets

(56) References Cited

FOREIGN PATENT DOCUMENTS

| | | | |
|---|---|---|---|
| JP | 2014-175383 | A | 9/2014 |
| JP | 2017-073536 | A | 4/2017 |
| WO | 2014/136843 | A1 | 9/2014 |

* cited by examiner

ELECTRONIC COMPONENT

TECHNICAL FIELD

One aspect of the present invention relates to an electronic component.

BACKGROUND

Known electronic components include a chip and a mounting conductor provided on a surface of the chip. In the electronic components, the mounting conductor is formed on an outer surface of the chip, and thus the size of the chip needs to be smaller by one size than a predetermined size of the electronic component. Therefore, the volume of the chip may not be sufficiently secured in some cases. In view of the foregoing, Japanese Patent No. 4816971 discloses an electronic component including an element and a mounting conductor disposed in a recess provided in the element. In the electronic component, the mounting conductor is disposed in the recess, and thus the volume of the element can be secured.

SUMMARY

In the above-described electronic component, cracks sometimes occur in the element.

One aspect of the present invention provides an electronic component in which the occurrence of cracks in the body is suppressed.

According to research and study by the inventors of the present invention, it has turned out that cracks are more likely to occur in the element due to the fact that the shrinkage amount of the configuration material of the mounting conductor is larger than the shrinkage amount of the configuration material of the element, shrinkage being caused due to thermal treatment in manufacturing the electronic component. Therefore, if the volume of the mounting conductor is reduced, the shrinkage amount of the configuration material of the mounting conductor can be reduced. However, to keep the mounting strength, it is necessary to maintain the area of the outer surface of the mounting conductor.

Therefore, an electronic component according to one aspect of the present invention includes an element provided with a first recess, and a mounting conductor including a first conductor portion disposed in the first recess. The first conductor portion has a first face opposed to a bottom face of the first recess, a second face opposed to the first face, and a third face connecting the first face and the second face. The third face has a region overlapping with the second face as viewed from an opposing direction of the bottom face of the first recess and the first face.

In this electronic component, the third face has the region overlapping with the second face as viewed from the opposing direction of the bottom face and the first face. Therefore, the volume of the first conductor portion can be reduced while the area of the second face is maintained, as compared with a case where the third face is provided in such a way as not to overlap with the second face. Therefore, since the shrinkage amount of a configuration material of the first conductor portion can be reduced, occurrence of cracks in the element is suppressed.

In the electronic component according to one aspect of the present invention, the region may be curved. For example, in a case where the region is configured from a plurality of planes and has a chamfered shape, there is a possibility of concentration of stress on corner portions of the region. In contrast, in the electronic component according to one aspect of the present invention, the region is curved and thus the stress can be relieved. Therefore, occurrence of cracks in the element is further suppressed.

In the electronic component according to one aspect of the present invention, the first face may have a first outer edge that defines the region, and the second face may have a second outer edge that defines the region. A relationship $0.75a \leq b \leq 2a$ may be satisfied where a separation distance between the first outer edge and the second outer edge in the opposing direction is a and a separation distance between the first outer edge and the second outer edge in a direction orthogonal to the opposing direction and the first outer edge is b. In this case, by satisfaction of $0.75a \leq b$, an angle made of a corner portion made by the region and the first face becomes sufficiently large, and thus the concentration of stress on the corner portion made by the region and the first face is suppressed. By satisfaction of $b \leq 2a$, the volume of the first conductor portion can be sufficiently reduced, and thus the shrinkage amount of the configuration material of the first conductor portion can be reduced. Therefore, occurrence of cracks in the element is further suppressed.

In the electronic component according to one aspect of the present invention, the element may have a mounting surface, and the first recess may be provided in the mounting surface. In this case, in mounting the electronic component on another electronic device, electrical connection between the first conductor portion and the another electronic device can be easily achieved.

In the electronic component according to one aspect of the present invention, the element further may have an end face continuing from the mounting surface and provided with a second recess. The second recess may be integrally provided with the first recess. The mounting conductor further may include a second conductor portion disposed inside the second recess and have an L shape in cross section. In this case, for example, in mounting the electronic component on another electronic device by solder connection, the solder is provided not only on the mounting surface but also on the end face, and thus the mounting strength can be increased.

In the electronic component according to one aspect of the present invention, the second conductor portion may have a fourth face opposed to a bottom face of the second recess, a fifth face opposed to the fourth face, and a sixth face connecting fourth face and the fifth face. The sixth face may have a region overlapping with the fifth face as viewed from an opposing direction of the bottom face of the second recess and the fourth face. Therefore, the volume of the second conductor portion can be reduced while the area of the fifth face is maintained, as compared with a case where the fourth face is provided in such a way as not to overlap with the fifth face. As a result, the shrinkage amount of the configuration material of the second conductor portion can be reduced, and thus occurrence of cracks in the element is further suppressed.

The electronic component according to one aspect of the present invention may further include a coil conductor that configures a coil in the element. The mounting conductor may be formed by laminating mounting conductor layers. A coil axis of the coil may be provided along a laminating direction of the mounting conductor layers. In this case, as compared with a case where the third face is provided in such a way as not to overlap with the second face, the outer diameter of the coil can be increased and a Q value (quality factor) of the coil can be improved while the area of the second face is maintained.

DETAILED DESCRIPTION

Figure 1:
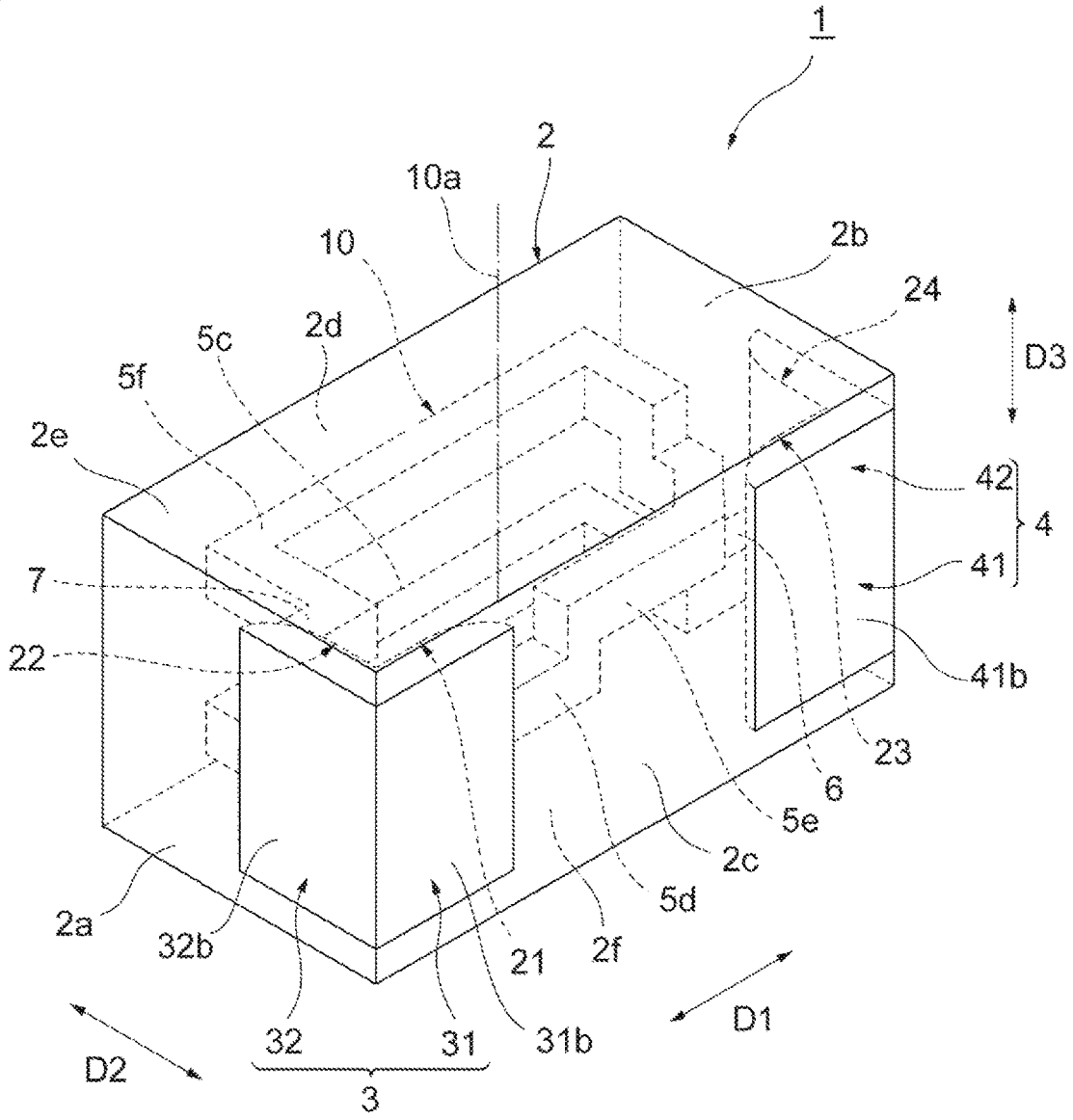
FIG. 1 is a perspective view of a laminated coil component according to an embodiment.

Hereinafter, embodiments will be described in detail with reference to the accompanying drawings. In the description, the same reference numeral is used for the same elements or elements having the same function, and redundant description is omitted.

Figure 2:
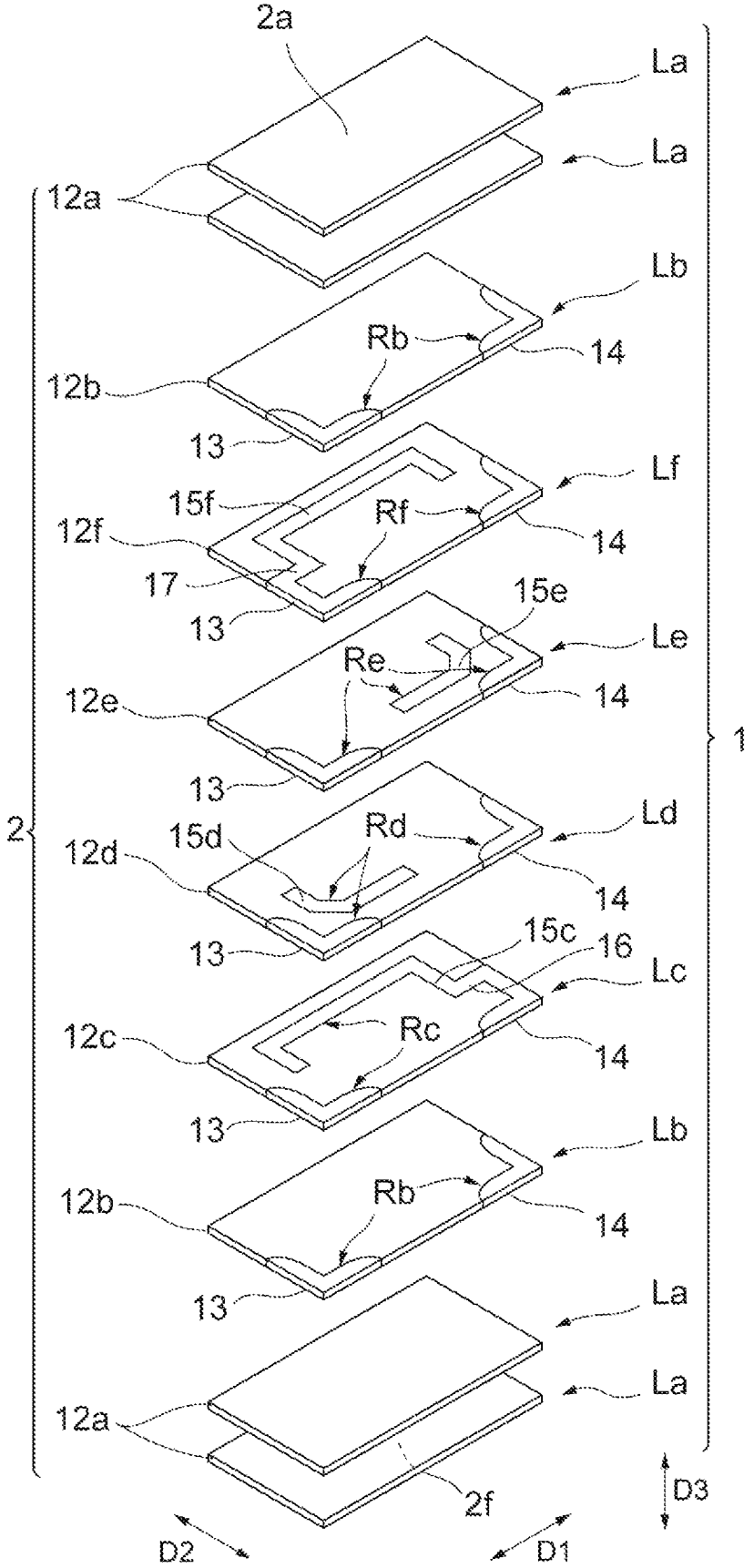
FIG. 2 is an exploded perspective view of the laminated coil component in FIG. 1.
Figure 3:
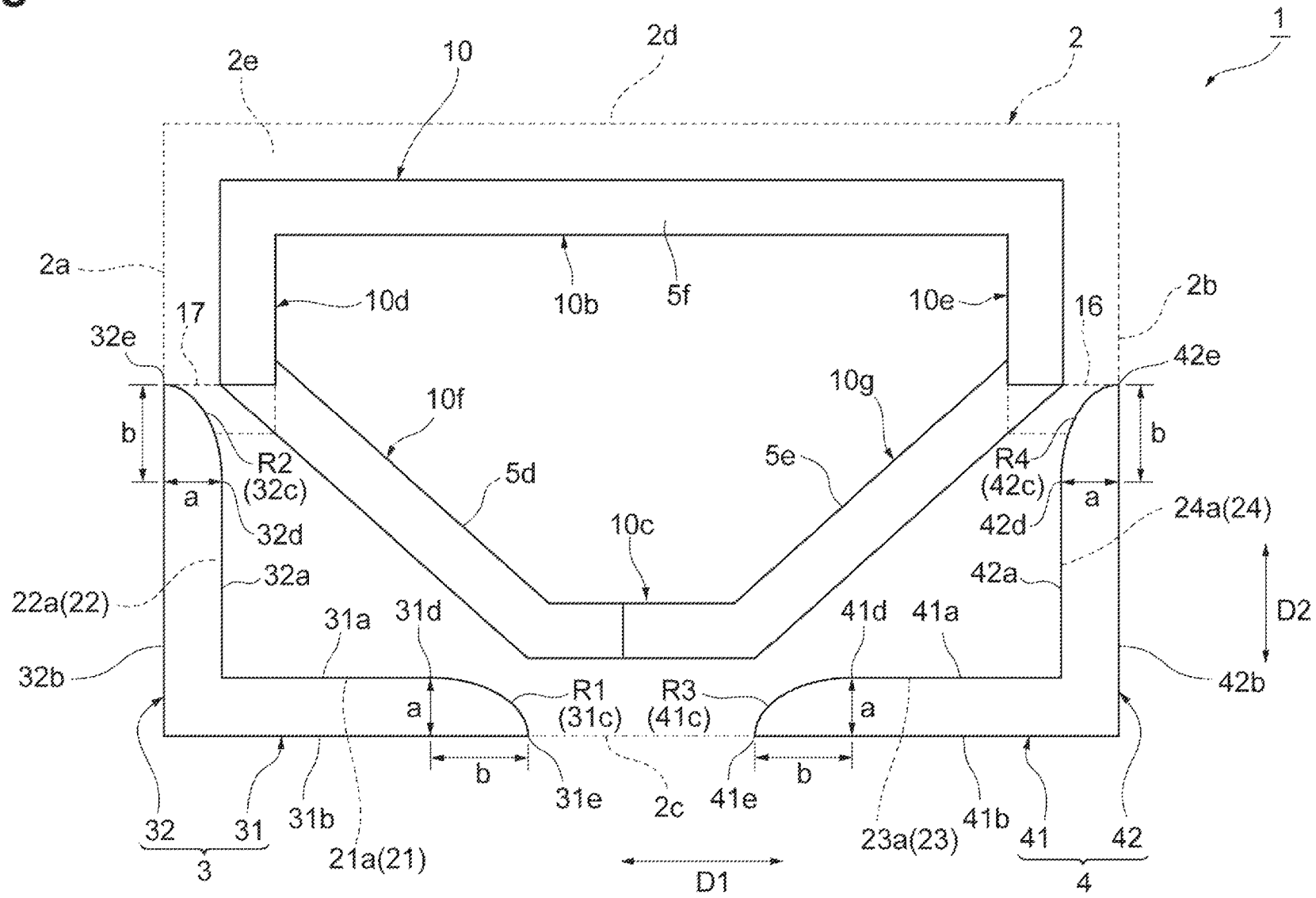
FIG. 3 is a plan view illustrating a relationship between a coil and a mounting conductor illustrated in FIG. 1.

A laminated coil component according to an embodiment will be described with reference to FIGS. 1 to 3. FIG. 1 is a perspective view of a laminated coil component according to an embodiment. FIG. 2 is an exploded perspective view of the laminated coil component illustrated in FIG. 1. FIG. 3 is a plan view illustrating a relationship between a coil and a mounting conductor illustrated in FIG. 1. FIG. 3 is a plan view of a laminated coil component 1 as viewed from a side face 2*e* side. In FIG. 3, an element 2 and connection conductors 6 and 7 are illustrated by the broken lines.

As illustrated in FIGS. 1 to 3, the laminated coil component 1 according to an embodiment includes the element 2, mounting conductors 3 and 4, a plurality of coil conductors 5*c*, 5*d*, 5*e*, and 5*f*, and the connection conductors 6 and 7.

The element 2 has a rectangular parallelepiped shape. The rectangular parallelepiped shape includes a rectangular parallelepiped shape with chamfered corner portions and ridge portions, and a rectangular parallelepiped shape with rounded corner portions and ridge portions. The element 2 has end faces 2*a* and 2*b* and side faces 2*c*, 2*d*, 2*e*, and 2*f*. The end faces 2*a* and 2*b* are opposed to each other. The side faces 2*c* and 2*d* are opposed to each other. The side faces 2*e* and 2*f* are opposed to each other. Hereinafter, an opposing direction of the end faces 2*a* and 2*b* is a direction D1, an opposing direction of the side faces 2*c* and 2*d* is a direction D2, and an opposing direction of the side faces 2*e* and 2*f* is a direction D3. The directions D1, D2, and D3 are approximately orthogonal to one another.

The end faces 2*a* and 2*b* extend in the direction D2 in such a way as to connect the side faces 2*c* and 2*d*. The end faces 2*a* and 2*b* also extend in the direction D3 in such a way as to connect the side faces 2*e* and 2*f*. The side faces 2*c* and 2*d* extend in the direction D1 in such a way as to connect the end faces 2*a* and 2*b*. The side faces 2*c* and 2*d* also extend in the direction D3 in such a way as to connect the side faces 2*e* and 2*f*. The side faces 2*e* and 2*f* extend in the direction D2 in such a way as to connect the side faces 2*c* and 2*d*. The side faces 2*e* and 2*f* also extend in the direction D1 in such a way as to connect the end faces 2*a* and 2*b*.

The side face 2*c* is a mounting surface and is a surface opposed to another electronic device (not illustrated, for example, a circuit base material or an electronic component) when the laminated coil component 1 is mounted on the another electronic device. The end faces 2*a* and 2*b* are surfaces continuing from the mounting surface (that is, the side face 2*c*).

The length of the element 2 in the direction D1 is longer than the length of the element 2 in the direction D2 and the length of the element 2 in the direction D3. The length of the element 2 in the direction D2 and the length of the element 2 in the direction D3 are equivalent to each other. That is, in the present embodiment, the end faces 2*a* and 2*b* have a square shape, and the side faces 2*c*, 2*d*, 2*e*, and 2*f* have a rectangular shape. The length of the element 2 in the direction D1 may be equivalent to, or longer or shorter than the length of the element 2 in the direction D2 and the length of the element 2 in the length in the direction D3. The length of the element 2 in the direction D2 and the length of the element 2 in the direction D3 may be different from each other.

The "equivalent" in the present embodiment may include values having a slight difference or a manufacturing error that falls within a preset range, in addition to equal values. For example, if a plurality of values falls within a range of ±5% of an average value of the plurality of values, the plurality of values is defined to be equivalent.

Recesses 21, 22, 23, and 24 are provided in the element 2. The recesses 21 and 22 are integrally provided and correspond to the mounting conductor 3. The recesses 23 and 24 are integrally provided and correspond to the mounting conductor 4.

The recess 21 is provided in the side face 2*c* on the end face 2*a* side and is depressed toward the side face 2*d*. The recess 21 has a bottom face 21*a*. The bottom face 21*a* has a rectangular shape, for example. The recess 22 is provided in the end face 2*a* on the side face 2*c* side and is depressed toward the end face 2*b*. The recess 22 has a bottom face 22*a*. The bottom face 22*a* has a rectangular shape, for example. The recess 23 is provided in the side face 2*c* on the end face 2*b* side and is depressed toward the side face 2*d*. The recess 23 has a bottom face 23*a*. The bottom face 23*a* has a rectangular shape, for example. The recess 24 is provided in the end face 2*b* on the side face 2*c* side and is depressed toward the end face 2*a*. The recess 24 has a bottom face 24*a*. The bottom face 24*a* has a rectangular shape, for example.

The recesses 21, 22, 23, and 24 have the same shape, for example. The recesses 21, 22, 23, and 24 are provided to be separated from the side faces 2*d*, 2*e*, and 2*f*. The recess 21 and the recess 23 are provided to be separated from each other in the direction D1.

The element 2 is configured from a plurality of element layers 12*a* to 12*f* laminated in the direction D3. A specific lamination structure will be described below. In the actual element 2, the plurality of element layers 12*a* to 12*f* is integrated to such an extent that boundaries between the element layers cannot be visually recognized. The element layers 12*a* to 12*f* are configured from, for example, a magnetic material (Ni—Cu—Zn ferrite material, Ni—Cu—Zn—Mg ferrite material, or Ni—Cu ferrite material). The magnetic material that configures the element layers 12*a* to 12*f* may contain a Fe alloy or the like. The element layers 12*a* to 12*f* may be configured from a nonmagnetic material (a glass ceramic material, a dielectric material, or the like).

The mounting conductor 3 is disposed in the recesses 21 and 22. The mounting conductor 4 is disposed in the recesses 23 and 24. The mounting conductors 3 and 4 are separated from each other in the direction D1. The mounting conductors 3 and 4 have the same shape, for example. The mounting conductors 3 and 4 have an L-shape in cross section, for example. The mounting conductors 3 and 4 can be said to exhibit an L shape as viewed from the direction D3, for example. Electrolytic plating or electroless plating is applied to outer surfaces of the mounting conductors 3 and 4, thereby to form a plating layer on the outer surfaces. The plating layer contains Ni, Sn, Au, or the like.

The mounting conductor 3 is configured from a plurality of mounting conductor layers 13 having an L shape as viewed from the direction D3 and laminated in the direction D3. That is, the laminating direction of the mounting conductor layer 13 is the direction D3. In the actual mounting conductor 3, the plurality of mounting conductor layers 13 is integrated to such an extent that boundaries between the layers cannot be visually recognized. The mounting conductor 3 has conductor portions 31 and 32. The conductor portions 31 and 32 are integrally formed. The conductor portions 31 and 32 have an approximately rectangular plate shape. The conductor portions 31 and 32 have the same shape, for example.

The conductor portion 31 is disposed in the recess 21. In particular, as illustrated in FIG. 3, the conductor portion 31 has a first face 31*a*, a second face 31*b*, and a third face 31*c*. The first face 31*a* is opposed to the bottom face 21*a* in the direction D2. The second face 31*b* is opposed to the first face 31*a* in the direction D2. The third face 31*c* connects the first face 31*a* and the second face 31*b*. The third face 31*c* has a region R1 overlapping with the second face 31*b* as viewed from the direction D2. The region R1 is curved as a whole.

The first face 31*a* has an outer edge 31*d* that defines the region R1. The second face 31*b* has an outer edge 31*e* that defines the region R1. The outer edges 31*d* and 31*e* extend along the direction D3 and are parallel to each other. The outer edge 31*d* is positioned closer to the end face 2*a* than the outer edge 31*e* is, as viewed from the direction D2. A relationship 0.75a≤b≤2a is satisfied where a separation distance between the outer edge 31*d* and the outer edge 31*e* in the direction D2 is a and the separation distance between the outer edge 31*d* and the outer edge 31*e* in the direction D1 is b.

The conductor portion 32 is disposed in the recess 22. In particular, as illustrated in FIG. 3, the conductor portion 32 has a first face 32*a*, a second face 32*b*, and a third face 32*c*. The first face 32*a* is opposed to the bottom face 22*a* in the direction D1. The second face 32*b* is opposed to the first face 32*a* in the direction D1. The third face 32*c* connects the first face 32*a* and the second face 32*b*. The third face 32*c* has a region R2 overlapping with the second face 32*b* as viewed from the direction D1. The region R2 is curved as a whole.

The first face 32*a* has an outer edge 32*d* that defines the region R2. The second face 32*b* has an outer edge 32*e* that defines the region R2. The outer edges 32*d* and 32*e* extend along the direction D3 and are parallel to each other. The outer edge 32*d* is positioned closer to the side face 2*c* side than the outer edge 32*e* is, as viewed from the direction D1. A relationship 0.75a≤b≤2a is satisfied where a separation distance between the outer edge 32*d* and the outer edge 32*e* in the direction D1 is a and the separation distance between the outer edge 32*d* and the outer edge 32*e* in the direction D2 is b.

The first face 31*a* and the first face 32*a* are orthogonal to each other and continuous. The second face 31*b* and the second face 32*b* are orthogonal to each other and continuous.

The mounting conductor 4 is configured from a plurality of mounting conductor layers 14 having an L shape as viewed from the direction D3 and laminated in the direction D3. That is, the laminating direction of the mounting conductor layer 14 is the direction D3. In the actual mounting conductor 4, the plurality of mounting conductor layers 14 is integrated to such an extent that boundaries between the layers cannot be visually recognized. The mounting conductor 4 has conductor portions 41 and 42. The conductor portions 41 and 42 are integrally formed. The conductor portions 41 and 42 have an approximately rectangular plate shape. The conductor portions 41 and 42 have the same shape, for example.

The conductor portion 41 is disposed in the recess 23. In particular, as illustrated in FIG. 3, the conductor portion 41 has a first face 41*a*, a second face 41*b*, and a third face 41*c*. The first face 41*a* is opposed to the bottom face 23*a* in the direction D2. The second face 41*b* is opposed to the first face 41*a* in the direction D2. The third face 41*c* connects the first face 41*a* and the second face 41*b*. The third face 41*c* has a region R3 overlapping with the second face 41*b* as viewed from the direction D2. The region R3 is curved as a whole.

The first face 41*a* has an outer edge 41*d* that defines the region R3. The second face 41*b* has an outer edge 41*e* that defines the region R3. The outer edges 41*d* and 41*e* extend along the direction D3 and are parallel to each other. The outer edge 41*d* is positioned closer to the end face 2*b* side than the outer edge 41*e* is, as viewed from the direction D2. A relationship 0.75a≤b≤2a is satisfied where a separation distance between the outer edge 41*d* and the outer edge 41*e* in the direction D2 is a and the separation distance between the outer edge 41*d* and the outer edge 41*e* in the direction D1 is b.

The conductor portion 42 is disposed in the recess 24. In particular, as illustrated in FIG. 3, the conductor portion 42 has a first face 42*a*, a second face 42*b*, and a third face 42*c*. The first face 42*a* is opposed to the bottom face 24*a* in the direction D1. The second face 42*b* is opposed to the first face 42*a* in the direction D1. The third face 42*c* connects the first face 42*a* and the second face 42*b*. The third face 42*c* has a region R4 overlapping with the second face 42*b* as viewed from the direction D1. The region R4 is curved as a whole.

The first face 42*a* has an outer edge 42*d* that defines the region R4. The second face 42*b* has an outer edge 42*e* that defines the region R4. The outer edges 42*d* and 42*e* extend along the direction D3 and are parallel to each other. The outer edge 42*d* is positioned closer to the side face 2*c* than the outer edge 42*e* is, as viewed from the direction D1. A relationship 0.75a≤b≤2a is satisfied where a separation distance between the outer edge 42*d* and the outer edge 42*e* in the direction D1 is a and the separation distance between the outer edge 42*d* and the outer edge 42*e* in the direction D2 is b.

The first face 41*a* and the first face 42*a* are orthogonal to each other and continuous. The second face 41*b* and the second face 42*b* are orthogonal to each other and continuous.

A plurality of coil conductors 5*c*, 5*d*, 5*e*, and 5*f* is connected to one another to configure a coil 10 in the element 2. The coil 10 is disposed in such a way as to be opposed to the third faces 31*c*, 32*c*, 41*c*, and 42*c*. A coil axis 10*a* of the coil 10 is provided along the direction D3. The coil conductors 5*c*, 5*d*, 5*e*, and 5*f* are disposed in such a way as to at least partially overlap one another as viewed from the direction D3. The coil conductors 5*c*, 5*d*, 5*e*, and 5*f* are disposed separated from the end faces 2*a* and 2*b* and the side faces 2*c*, 2*d*, 2*e*, and 2*f*.

As illustrated in FIG. 3, the coil 10 has a hexagonal shape as viewed from the direction D3. The coil 10 has portions lob, 10*c*, 10*d*, 10*e*, 10*f*, and 10*g*.

The portion 10*b* is disposed along the side face 2*d*. The length of the portion 10*b* in the direction D1 is from 30% to 98%, both inclusive, more favorably from 60% to 98%, both inclusive, of the length of the element 2 in the direction D1. The portion 10*b* is disposed in a central portion of the element 2 in the direction D1. That is, the separation distance between the portion 10*b* and the end face 2*a* in the direction D1 and the separation distance between the portion 10*b* and the end face 2*b* in the direction D1 are equivalent to each other. The separation distance between the portion

10*b* and the side face 2*d* in the direction D2 is from 1.5% to 30%, both inclusive, more favorably from 1.5% to 10%, both inclusive, of the length of the element 2 in the direction D2.

The portion 10*c* is disposed along the side face 2*c*. The length of the portion 10*c* in the direction D1 is from 5% to 95%, both inclusive, more favorably from 60% to 95%, both inclusive, of the length of the element 2 in the direction D1. The portion 10*c* is disposed in a central portion of the element 2 in the direction D1. That is, the separation distance between the portion 10*c* and the end face 2*a* in the direction D1 and the separation distance between the portion 10*c* and the end face 2*b* in the direction D1 are equivalent to each other. The separation distance between the portion 10*c* and the side face 2*c* in the direction D2 is from 1.5% to 60%, both inclusive, more favorably from 1.5% to 10%, both inclusive, of the length of the element 2 in the direction D2.

The portion 10*d* is connected to an end portion of the portion 10*b* on the end face 2*a* side, and is disposed along the end face 2*a*. The length of the portion 10*d* in the direction D2 is from 10% to 90%, both inclusive, more favorably from 10% to 50%, both inclusive, of the length of the element 2 in the direction D2.

The portion 10*e* is connected to an end portion of the portion 10*b* on the end face 2*b* side, and is disposed along the end face 2*b*. The length of the portion 10*e* in the direction D2 is from 10% to 90%, both inclusive, more favorably from 10% to 50%, both inclusive, of the length of the element 2 in the direction D2. The portion 10*e* has the same shape as the portion 10*d*, for example.

The portion 10*f* connects an end portion of the portion 10*c* on the end face 2*a* side and an end portion of the portion 10*d* on the side face 2*c* side. The portion 10*g* connects an end portion of the portion 10*c* on the end face 2*b* side and an end portion of the portion 10*e* on the side face 2*c* side.

The coil conductor 5*c* configures one end portion of the coil 10. One end portion of the coil conductor 5*c* and the connection conductor 6 are adjacent to each other in the direction D1 and are connected to each other. Another end portion of the coil conductor 5*c* and one end portion of the coil conductor 5*d* are adjacent to each other in the direction D3 and are connected to each other. The other end portion of the coil conductor 5*d* and one end portion of the coil conductor 5*e* are adjacent to each other in the direction D3 and are connected to each other. The other end portion of the coil conductor 5*e* and one end portion of the coil conductor 5*f* are adjacent to each other in the direction D3 and are connected to each other. The other end portion of the coil conductor 5*f* and the connection conductor 7 are adjacent to each other in the direction D1 and are connected to each other.

The coil conductors 5*c*, 5*d*, 5*e*, and 5*f* are configured from a plurality of coil conductor layers 15*c*, 15*d*, 15*e*, and 15*f* laminated in the direction D3. That is, the plurality of coil conductor layers 15*c*, 15*d*, 15*e*, and 15*f* is disposed in such a way that all the coil conductor layers overlap one another as viewed from the direction D3. The coil conductors 5*c*, 5*d*, 5*e*, and 5*f* may be configured from one set of coil conductor layers 15*c*, 15*d*, 15*e*, and 15*f*. FIG. 2 illustrates only one set of coil conductor layers 15*c*, 15*d*, 15*e*, and 15*f*. In the actual coil conductors 5*c*, 5*d*, 5*e*, and 5*f*, the plurality of coil conductor layers 15*c*, 15*d*, 15*e*, and 15*f* is integrated to such an extent that boundaries between the layers cannot be visually recognized.

The connection conductor 6 extends in the direction D1 and is connected to the coil conductor 5*c* of the coil 10 and the conductor portion 42. The connection conductor 7 extends in the direction D1 and is connected to the coil conductor 5*f* and the conductor portion 32. The connection conductors 6 and 7 are configured from a plurality of connection conductor layers 16 and 17 laminated in the direction D3. In FIG. 2, only one set of connection conductor layers 16 and 17 is illustrated. In the actual connection conductors 6 and 7, the plurality of connection conductor layers 16 and 17 is integrated to such an extent that boundaries between the layers cannot be visually recognized.

The mounting conductor layers 13 and 14, the coil conductor layers 15*c*, 15*d*, 15*e*, and 15*f*, and the connection conductor layers 16 and 17 are configured from a conductive material (for example, Ag or Pd). These layers may be configured from the same material or different materials. These layers have an approximately rectangular shape in cross section.

The laminated coil component 1 has a plurality of layers La, Lb, Lc, Ld, Le, and Lf. For example, the laminated coil component 1 is configured from two layers La, one layer Lb, three layers Lc, three layers Ld, three layers Le, three layers Lf, one layer Lb, and two layers La laminated in order from the side face 2*f* side. In FIG. 2, each one of the three layers Lc, three layers Ld, three layers Le, and three layers Lf is illustrated, and the other two are not illustrated.

The layer La is configured from the element layer 12*a*.

The layer Lb is configured from the element layer 12*b* in combination with the mounting conductor layers 13 and 14. The element layer 12*b* is provided with defect portions Rb. The defect portions Rb have shapes corresponding to the shapes of the mounting conductor layers 13 and 14. The mounting conductor layers 13 and 14 are fit to the defect portions Rb. The element layer 12*b* and the mounting conductor layers 13 and 14 as a whole have a complementary relationship with each other.

The layer Lc is configured from the element layer 12*c* in combination with the mounting conductor layers 13 and 14 and the coil conductor layer 15*c*. The element layer 12*c* is provided with defect portions Rc. The defect portions Rc have shapes corresponding to the shapes of the mounting conductor layers 13 and 14, the coil conductor layer 15*c*. The mounting conductor layers 13 and 14, the coil conductor layer 15*c*, and the connection conductor layer 16 are fit to the defect portions Rc. The element layer 12*c*, and the mounting conductor layers 13 and 14, the coil conductor layer 15*c*, and the connection conductor layer 16 as a whole have a complementary relationship with each other.

The layer Ld is configured from the element layer 12*d* in combination with the mounting conductor layers 13 and 14 and the coil conductor layer 15*d*. The element layer 12*d* is provided with defect portions Rd. The defect portions Rd have shapes corresponding to the shapes of the mounting conductor layers 13 and 14 and the coil conductor layer 15*d*. The mounting conductor layers 13 and 14 and the coil conductor layer 15*d* are fit to the defect portions Rd. The element layer 12*d*, and the mounting conductor layers 13 and 14, and the coil conductor layer 15*d* as a whole have a complementary relationship with each other.

The layer Le is configured from the element layer 12*e* in combination with the mounting conductor layers 13 and 14 and the coil conductor layer 15*e*. The element layer 12*e* is provided with defect portions Re. The defect portions Re have shapes corresponding to the shapes of the mounting conductor layers 13 and 14 and the coil conductor layer 15*e*. The mounting conductor layers 13 and 14 and the coil conductor layer 15*e* are fit to the defect portions Re. The element layer 12*e*, and the mounting conductor layers 13 and 14 and the coil conductor layer 15*e* as a whole have a complementary relationship with each other.

The layer Lf is configured from the element layer 12*f* in combination with the mounting conductor layers 13 and 14, the coil conductor layer 15*f*, and the connection conductor layer 17. The element layer 12*f* is provided with defect portions Rf. The defect portions Rf have shapes corresponding to the shapes of the mounting conductor layers 13 and 14, the coil conductor layer 15*f*, and the connection conductor layer 17. The mounting conductor layers 13 and 14, the coil conductor layer 15*f*, and the connection conductor layer 17 are fit to the defect portions Rf. The element layer 12*f*, and the mounting conductor layers 13 and 14, the coil conductor layer 15*f*, and the connection conductor layer 17 as a whole have a complementary relationship with each other.

The defect portions Rb, Rc, Rd, Re, Rf are integrated to configure the aforementioned recesses 21, 22, 23, and 24. The widths of the defect portions Rb, Rc, Rd, Re, and Rf (hereinafter, the widths of the defect portions) are basically set to be larger than the widths of the mounting conductor layers 13 and 14, the coil conductor layers 15*c*, 15*d*, 15*e*, and 15*f*, and the connection conductor layers 16 and 17 (hereinafter, the widths of the conductor portions). To improve the adhesive property among the element layers 12*b*, 12*c*, 12*d*, 12*e*, and 12*f*, the mounting conductor layers 13 and 14, the coil conductor layers 15*c*, 15*d*, 15*e*, and 15*f*, and the connection conductor layers 16 and 17, the widths of the defect portions may be purposely set to be narrower than the widths of the conductor portions. A value obtained by subtracting the width of the conductor portion from the width of the defect portion is favorably, for example, from −3 μm to 10 μm, both inclusive, and more favorably from 0 μm to 10 μm, both inclusive.

An example of a method for manufacturing the laminated coil component 1 according to an embodiment will be described.

First, an element forming layer is formed by applying an element paste containing a configuration material of the above-described element layers 12*a* to 12*f* and a photosensitive material to a base material (for example, a PET film) The photosensitive material contained in the element paste may be either a negative type or a positive type, and a known photosensitive material can be used. Next, the element forming layer is exposed and developed by a photolithography method using a Cr mask, for example, to form an element pattern from which a shape correspond to the shape of a conductor forming layer described below is removed, on the base material. The element pattern is a layer to serve as the element layers 12*b*, 12*c*, 12*d*, 12*e*, and 12*f* after thermal treatment. That is, the element pattern provided with defect portions that are to serve as the defect portions Rb, Rc, Rd, Re, and Rf is formed. The "photolithography method" of the present embodiment is not limited to a type of mask or the like, and may be any method of processing a desired pattern by exposing and developing a layer to be processed containing a photosensitive material.

Meanwhile, a conductor forming layer is formed by applying a conductor paste containing configuration materials of the mounting conductor layers 13 and 14, the coil conductor layers 15*c*, 15*d*, 15*e*, and 15*f*, and the connection conductor layer 16 and 17, and a photosensitive material to the base material (for example, a PET film). The photosensitive material contained in the conductor paste may be either a negative type or a positive type, and a known photosensitive material can be used. Next, the conductor forming layer is exposed and developed by a photolithography method using a Cr mask, for example, to form a conductor pattern on the base material. The conductor pattern is a layer to serve as the mounting conductor layers 13 and 14, the coil conductor layers 15*c*, 15*d*, 15*e*, and 15*f* and the connection conductor layer 16 and 17 after thermal treatment.

Next, the element forming layer is transferred from the base material onto a support. In the present embodiment, two element forming layers are laminated on the support by repetition of the transfer step of the element forming layer twice. These element forming layers are layers to serve as the layers La after thermal treatment.

Next, the conductor patterns and the element patterns are laminated in the direction D3 by being repeatedly transferred them onto the support. Specifically, first, the conductor pattern is transferred from the base material onto the element forming layer. Next, the element pattern is transferred from the base material onto the element forming layer. The conductor pattern is combined with the defect portion of the element pattern, and the element pattern and the conductor pattern become the same layer on the element forming layer. Further, the transfer steps of the conductor pattern and element pattern are repeatedly performed, and the conductor pattern and the body pattern are laminated in a state of being combined with each other. According to this process, layers to serve as the layers Lb, Lc, Ld, Le, and Lf after thermal treatment are laminated.

Next, the element forming layer is transferred from the base material onto the layer laminated in the transfer step of the conductor pattern and the element pattern. In the present embodiment, two element forming layers are laminated on the layer by repetition of the transfer step of the element forming layer twice. These element forming layers are layers to serve as the layers La after thermal treatment.

By the above process, a laminate that configures the laminated coil component 1 after thermal treatment is formed on the support. Next, the obtained laminate is cut into a predetermined size. Next, after a debinding process is performed for the cut laminate, thermal treatment is performed. The thermal treatment temperature is, for example, about 850 to 900° C. Next, if necessary, a plating layer is formed on the outer surfaces of the mounting conductors 3 and 4. According to this process, the laminated coil component 1 is obtained.

As described above, in the conductor portions 31 and 41 of the mounting conductors 3 and 4, the third faces 31*c* and 41*c* have the regions R1 and R2 overlapping with the second faces 31*b* and 41*b*. Therefore, as compared with a case where the third faces 31*c* and 41*c* are provided in such a way as not to overlap with the second faces 31*b* and 41*b*, the volume of the conductor portions 31 and 41 can be reduced while the areas of the second faces 31*b* and 41*b* are maintained. As a result, the shrinkage amount of the configuration material of the conductor portions 31 and 41 can be reduced, and thus the occurrence of cracks in the element 2 is suppressed.

The element 2 has the side face 2*c* as a mounting surface. The recesses 21 and 23 in which the conductor portions 31 and 41 are disposed are provided in the side face 2*c*. Therefore, when the laminated coil component 1 is mounted on another electronic device, electrical connection between the conductor portions 31 and 41 and the another electronic devices can be easily achieved.

The element 2 has the end faces 2*a* and 2*b* continuing from the side face 2*c*. The end faces 2*a* and 2*b* are provided with the recesses 22 and 24. The mounting conductors 3 and 4 have the conductor portions 32 and 42 disposed in the recesses 22 and 24. The mounting conductors 3 and 4 have an L shape in cross section. Therefore, for example, when the laminated coil component 1 is mounted on another electronic device by solder connection, the solder is provided not only on the side face 2*c* but also on the end faces 2*a* and 2*b*. Therefore, the mounting strength can be further enhanced.

The conductor portions 32 and 42 have the third faces 32*c* and 42*c*, and the third faces 32*c* and 42*c* have the regions R3 and R4 overlapping with the second faces 32*b* and 42*b*. Therefore, as compared with a case where the third faces 32*c* and 42*c* are provided in such a way as not to overlap with the second faces 32*b* and 42*b*, the volume of the conductor portions 32 and 42 can be reduced while the areas of the second faces 32*b* and 42*b* are maintained. As a result, the shrinkage amount of the configuration material of the conductor portions 32 and 42 can be reduced, and thus the occurrence of cracks in the element 2 is further suppressed.

According to the research and study by the inventors of the present invention, the cracks are more likely to occur in the vicinity of the conductor portions 31, 32, 41, and 42 and at the portions separated from the conductor portions 31, 32, 41, and 42 in the element 2. According to the present embodiment, occurrence of such cracks can be suppressed.

For example, in a case where the regions R1 to R4 are configured from a plurality of planes having a chamfered shape, there is a possibility of concentration of stress on corners of the regions R1 to R4. In contrast, in the laminated coil component 1, the regions R1 to R4 are curved, and thus the stress can be relieved. Therefore, occurrence of cracks in the element 2 is further suppressed.

In the conductor portions 31 and 41, the relationship $0.75a \leq b \leq 2a$ is satisfied where the separation distance between the outer edges 31*d* and 41*d* and the outer edges 31*e* and 41*e* in the direction D2 is a and the separation distance between the outer edges 31*d* and 41*d* and the outer edges 31*e* and 41*e* in the direction D1 is b. In the conductor portions 32 and 42, the relationship $0.75a \leq b \leq 2a$ is satisfied where the separation distance between the outer edges 32*d* and 42*d* and the outer edges 32*e* and 42*e* in the direction D1 is a and the separation distance between the outer edges 32*d* and 42*d* and the outer edges 32*e* and 42*e* in the direction D2 is b. By satisfaction of $0.75a \leq b$, an angle of a corner portion made by the region R1 and the first face 31*a*, an angle of a corner portion made by the region R2 and the first face 32*a*, an angle of a corner portion made by the region R3 and the first face 41*a*, and an angle of a corner portion made by the region R4 and the first face 42*a* become sufficiently large, and thus concentration of stress on these corner portions is suppressed. By satisfaction of $b \leq 2a$, the volume of the conductor portions 31, 32, 41, and 42 can be sufficiently reduced, and thus the shrinkage amount of the configuration material of the conductor portions 31, 32, 41, and 42 can be reduced. Therefore, occurrence of cracks in the element 2 is further suppressed.

The mounting conductors 3 and 4 are formed of the mounting conductor layers 13 and 14 laminated in the direction D3. The coil axis 10*a* of the coil 10 is provided along the direction D3. Therefore, as compared with a case where the third faces 31*c*, 32*c*, 41*c*, and 42*c* are provided in such a way as not to overlap with the second faces 31*b*, 32*b*, 41*b*, and 42*b* in the conductor portions 31, 32, 41, and 42, the outer diameter of the coil 10 can be increased and 42*b*, and a Q value (quality factor) of the coil 10 can be improved while the areas of the second faces 31*b*, 32*b*, 41*b*. As compared with the case where the third faces 31*c*, 32*c*, 41*c*, and 42*c* are provided in such a way as not to overlap with the second faces 31*b*, 32*b*, 41*b*, and 42*b*, close contact of the coil 10 and the mounting conductors 3 and 4 is suppressed. As a result, the outer diameter of the coil 10 can be increased and the Q value of the coil 10 can be improved while the occurrence of cracks between the coil 10 and the mounting conductors 3 and 4 can be suppressed.

The present invention is not limited to the above-described embodiment, and various modifications can be made.

The laminated coil component 1 may further include a core portion inside the coil 10 as viewed from the direction D3. The core portion may be hollow. That is, the laminated coil component 1 may be an air-core coil. The core portion may be solid and may be configured from a magnetic material different from the configuration material of the element 2, for example. The core portion may penetrate the element 2 in the direction D3 or may be covered with the element 2 at both end portions in the direction D3. The laminated coil component 1 may further include a spacer disposed between the coil conductors 5*c*, 5*d*, 5*e*, and 5*f* in the direction D3, and the spacer may be configured from a magnetic material or a nonmagnetic material different from the configuration material of the element 2.

In the laminated coil component 1, at least one of the third faces 31*c*, 32*c*, 41*c*, and 42*c* may have the regions R1, R2, R3, and R4. The recesses 21, 22, 23, and 24 do not necessarily have the same shape. Similarly, the conductor portions 31, 32, 41, and 42 do not necessarily have the same shape.

The mounting conductor 3 may just have either one of the conductor portions 31 and 32, and the element 2 may just be provided with either one of the recesses 21 and 22, corresponding to the conductor portions 31 and 32. The mounting conductor 4 may just have either one of the conductor portions 41 and 42, and the element 2 may just be provided with either one of the recesses 23 and 24, corresponding to the conductor portions 41 and 42.

The regions R1, R2, R3, and R4 may partially include a plane, or the whole regions may be configured from one or a plurality of planes. The regions R1, R2, R3, and R4 may be configured from a plurality of planes and may have a chamfered shape.

In the above-described embodiment, the laminated coil component 1 has been described as an example of an electronic component. However, the present invention is not limited to the example, and can be applied to a laminated ceramic capacitor, a laminated varistor, a laminated piezoelectric actuator, a laminated thermistor, or another electronic component such as a laminated composite component.

What is claimed is:

1. An electronic component comprising:

an element having a first recess; and a mounting conductor comprising a plurality of laminated mounting conductor layers and including a first conductor portion in the first recess, wherein the first conductor portion has a first face opposed to a bottom face of the first recess, a second face that is an opposite face of the first conductor portion from the first face, and a third face connecting the first face and the second face, the third face has a region overlapping with the second face as viewed from an opposing direction of the bottom face of the first recess and the first face, the plurality of laminated mounting conductor layers are integrated such that all adjacent side surfaces of the plurality of laminated mounting conductor layers are abutting, the region has a first edge at the interface between the third face and the first face and a second edge at the interface between the third face and the second face, and $0.75a \leq b \leq 2a$, when a is the distance between the first edge and the second edge in the opposing direction and b is the distance between the first edge and the second edge in a direction orthogonal to the opposing direction.

2. The electronic component according to claim 1, wherein the region is curved.

3. The electronic component according to claim 1, wherein the element has a mounting surface, and the first recess is provided in the mounting surface.

4. The electronic component according to claim 3, wherein the element further has an end face continuing from the mounting surface and provided with a second recess, the second recess is integrally provided with the first recess, and the mounting conductor further includes a second conductor portion disposed inside the second recess and has an L shape in cross section.

5. The electronic component according to claim 4, wherein the second conductor portion has a fourth face opposed to a bottom face of the second recess, a fifth face opposed to the fourth face, and a sixth face connecting the fourth face and the fifth face, and the sixth face has a region overlapping with the fifth face as viewed from an opposing direction of the bottom face of the second recess and the fourth face.

6. The electronic component according to claim 4, further comprising:

a coil conductor configuring a coil in the element, wherein the mounting conductor is formed by laminating mounting conductor layers, and a coil axis of the coil is provided along a laminating direction of the mounting conductor layers.

7. The electronic component according to claim 1, wherein the plurality of laminated continuous mounting conductor layers is laminated in a direction parallel to the first face and the second face.

8. The electronic component according to claim 1, wherein:

the element includes an internal coil conductor; and the third face is closer to the internal coil conductor than the first face and the second face.

9. The electronic component according to claim 1, wherein:

the element includes an internal coil conductor; and the mounting conductor is a separate component from the internal coil conductor, is connected to internal coil conductor and is configured for mounting and electrically connecting the electronic component to another electronic device.

* * * * *